United States Patent [19]

McConnell, Jr.

[11] Patent Number: 4,741,179

[45] Date of Patent: May 3, 1988

[54] MULTI-POST EARRING STRUCTURE FOR PIERCED EARS

[76] Inventor: Theo McConnell, Jr., 706 7th St., Pitcairn, Pa. 15140

[21] Appl. No.: 917,476

[22] Filed: Oct. 10, 1986

[51] Int. Cl.[4] ..... A44C 7/00

[52] U.S. Cl. ..... 63/13; D11/78

[58] Field of Search ..... 63/12, 13, 2; D11/77, D11/78; 128/339

[56] References Cited

U.S. PATENT DOCUMENTS

| | | | |
|---|---|---|---|
| 2,258,413 | 10/1941 | Koven | 63/15 X |
| 2,629,989 | 3/1953 | McDonald | 63/13 |
| 4,204,541 | 5/1980 | Kapitanov | 128/339 |
| 4,221,118 | 9/1980 | Chicckine | 63/13 |
| 4,353,225 | 10/1982 | Rogers | 63/13 |
| 4,489,572 | 12/1984 | Wilczewski | 63/13 |
| 4,497,186 | 2/1985 | Mason | D11/78 |
| 4,595,007 | 6/1986 | Mericle | 63/12 |

OTHER PUBLICATIONS

Washingtonian Magazine Dec./Jan. 1983 Towne Silversmith Advertisement.

*Primary Examiner*—Richard J. Johnson

*Attorney, Agent, or Firm*—Clifford A. Poff; Thomas H. Murray

[57] ABSTRACT

An ear ornament allowing attachment to an ear lobe containing more than one hole pierced therethrough. The ornament contains two or more bent portions for extension through the holes on the ear lobe allowing the ear ornament to be secured on the ear lobe without the need for a separate fastening means.

12 Claims, 1 Drawing Sheet

MULTI-POST EARRING STRUCTURE FOR PIERCED EARS

BACKGROUND OF THE INVENTION

1. Field of the Invention:

The present invention relates generally to earrings, and, more particularly, to an earring for attachment to an ear through which a plurality of holes have been pierced.

2. DESCRIPTION OF THE PRIOR ART

The use of earrings for ornamental purposes is a custom dating back through many millenia, such use exhibited in many divergent forms throughout a wide variety of cultures. Earrings may be worn for a variety of purposes, such as, for example, an expression of social status, a means of promoting self-expression, or a means of promoting individuality.

Earring designs include those disclosed in U.S. Pat. Nos. 236,935; 280,726; 3,446,033; 4,221,118; 4,489,572; and 4,497,186. Many earring designs, including those disclosed in the aforementioned Letters Patent, require the piercing of a hole through the ear lobe of the wearer to allow attachment of the earring thereto.

Most conventional earring designs for pierced ears include a post-element extending through the hole pierced in the ear lobe with an ornamental element connected to one end of the post-member and a fastening means, such as a clasp, removably connected to the other end of the post member for securing the earring in place. Various disclosures, such as, for example, U.S. Pat. Nos. 280,726; 3,446,033; and 4,221,118 discuss improvements to the fastening means to ensure that the earring is held in place. At least one patent (U.S. Pat. No. 4,497,186) discloses an earring which obviates the need for a separate fastener means.

Recent trends and fashions have popularized the use of two or more conventional earrings attached to each ear lobe, such use requiring the piercing of two or more holes in each ear lobe of the wearer.

With the additional hole or holes pierced in the ear lobe of the wearer, a radical departure of conventional earring designs is made possible.

It is, therefore, an object of the present invention to provide an earring designed to allow attachment to an ear lobe containing two holes pierced therethrough.

It is a further object of the present invention to provide an earring design which obviates the need for a separate fastener means to secure the earring.

It is a still further object of the present invention to provide an earring designed to allow attachment to an ear lobe containing more than two holes pierced therethrough.

SUMMARY OF THE PRESENT INVENTION

In accordance with the present invention, an ear ornament for attachment to an ear lobe through which a plurality of holes have been pierced includes a unitary rod member having a first bent portion, a second bent portion, and a central portion therebetween. The first and second bent portions are spaced apart by the central portion to extend through two of the plurality of pierced holes to thereby retain the ornament on the ear lobe, and the central portion forms a bight which can be adjustably bent to change the spacing between the first and second portions.

In a further embodiment of the present invention, an ornamental member is attached to the bight. In a still further embodiment of the present invention, the bight forms a geometrical shape which may be, for example, a circle.

In a yet further embodiment of the present invention, the rod member includes hetical or spiral configuration having convolutions made up of a plurality of bent portions wherein a central portion thereof forms a bight. The convolutions are spaced apart at an adjustable distance so that two or more convolutions can be threaded through the plurality of pierced holes to thereby retain the rod member on the ear lobe, and the plurality of bights can be used when desired to support attachments forming ornaments.

BRIEF DESCRIPTION OF THE DRAWINGS

The invention may be better understood and further advantages and uses thereof more readily apparent when considered in view of the following detailed description of exemplary embodiments taken with the accompanying drawings in which.

THE PREFERRED EMBODIMENT

Figure 1:
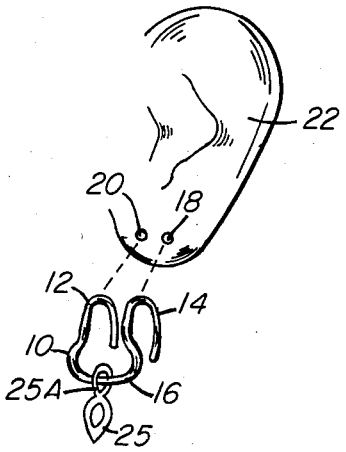
FIG. 1 is an illustration of one embodiment of a earring constructed according to the teachings of the present invention in which the earring includes two retaining members and a circular central bight section, the retaining members used to extend through the holes pierced through an ear lobe of the wearer.

Referring now to FIG. 1, an earring constructed according to the teachings of the present invention is identified by reference numeral 10 and includes a first bent retaining portion 12 and a second bent retaining portion 14, the portions 12 and 14 joined together in a unitary fashion by a bight 16 therebetween. Preferably, this earring consists of a unitary length of wire which is bent. The portions 12 and 14 are of dimensions suitable for insertion through pierced holes 18 and 20 on an ear lobe 22 of a wearer. Preferably, earring 10 is of a pliable material to allow suitable bending of the bight 16 so that the portions 12 and 14 conform to the specific separation distance between holes 18 and 20. The portions 12 and 14 are bent to form a generally "U-shaped" configuration so that one leg part, of each portion 12 and 14, can be inserted through holes 18 and 20 respectively thereby allowing the earring 10 to be supported on ear lobe 21 without the need for any other fastening means. An ornament 22 which contains a loop 23 may be threaded from either end portion to bight 16 if so desired.

Figure 2:
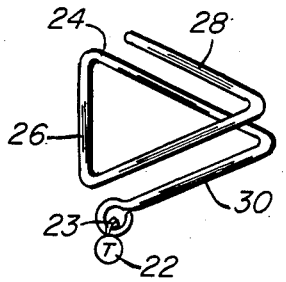
FIG. 2 is an illustration of another embodiment of the earring of the present invention in which the central bight section is triangular in shape.

An alternative embodiment to the earring 10 shown in FIG. 1 is the form illustrated in FIG. 2, identified generally by reference numeral 24, in which bight 26 is shaped to form a triangle. In this embodiment, bent retaining portions 28 and 30 are bent at opposing angles. Once again, earring 24 is secured on an ear lobe without the need of any other fastening means. An Ornament 25 which a clasp loop or preferably a releasable clasping mechanism 25A thereon, once again, may additionally be hung from bight 26 if so desired. Bight 26 and bent retaining portions 28 and 30 define one convolution which, as will be apparent hereinafter, can be extended to a plurality of convolutions. Attached to one end of earring 24 is a gapped, circular retaining member 27 to allow ornaments to alternatively be hung therefrom.

Figure 3:
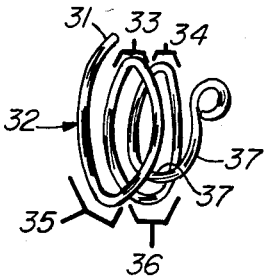
FIG. 3 is an illustration of a further embodiment of the earring of the present invention suitable for attachment to an ear lobe containing two holes pierced therethrough, such earring containing two central bight sections.

FIG. 3 illustrates another form of the preferred embodiment in which the earring takes the form of a succession of convolutions. Shown generally as 32, the earring is rotated in a manner to thread a leading end 31 of the helical convolution through a first pierced hole in an ear lobe, then in a second pierced hole to become self-supporting on the ear lobe thereby. The portions of the earring which engage in the pierced holes are retaining portions identified by reference numerals 33 and 34. Once again, ornaments which contain a releasable clasping mechanism thereon may additionally be hung from bight 35 and/or 36, respectively, if so desired. An additional, final convolution 37 of earring 32 of a smaller diameter allows ornaments to alternatively be hung therefrom. If three pierced holes are provided then when desired the leading end can be threaded in the third hole whereby a portion 37*a* comprises a retaining portion.

Figure 4:
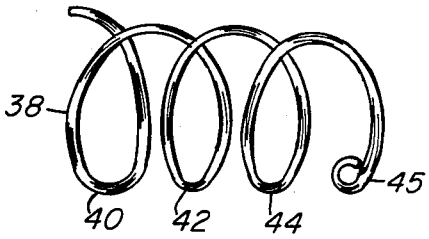
FIG. 4 is an illustration of an embodiment of the earring of the present invention suitable for attachment to an ear lobe in which at least three holes have been pierced therethrough.

FIG. 4 illustrates another form of the preferred embodiment in which the earring takes the form of a spiral convolution, similar to that of FIG. 3, but further adapted to extend through a third hole on an ear lobe. Shown generally as 38, the earring is rotated so that a leading end 39 passes through a first hole on an ear lobe, then a second hole, and finally rotated through a third hole on the ear lobe to become self-supporting thereby. Once again, ornaments may additionally be hung from bight 40, 42, and/or 44, respectively, if so desired. Connecting bights 40, 42 and 44, together are retaining portions 41, 43 and 45. Once again, an additional, final convolution 46 of earring 38 of a smaller diameter allows ornaments to alternatively be hung therefrom.

Figure 5:
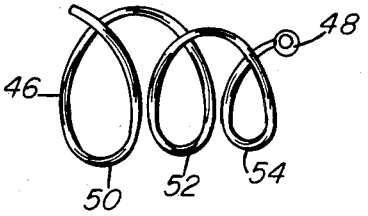
FIG. 5 is an illustration of a yet further embodiment of the earring of the present invention which includes a clasp positioned at the end of the earring.

Shown in FIG. 5 is an embodiment similar to that of FIG. 4 for attachment to an ear lobe in which three holes have been pierced therethrough. Further attached to one end of the earring 47 is a clasping mechanism 48 to allow releasable attachment of an ornament thereto. Once again, ornaments may additionally be hung from bight 50, 52, and/or 54, if so desired. The bights are connected together by retaining portions 51, 53 and 55.

Figure 6:
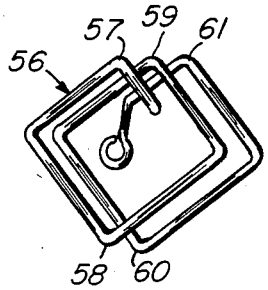
FIG. 6 is an illustration of a still further embodiment of the earring of the present invention suitable for attachment to an ear lobe containing three holes pierced therethrough in which the central bight sections take the form of squares.

A final form of the preferred embodiment is illustrated in FIG. 6, which, similar to the embodiments illustrated in FIGS. 4 and 5 is adapted to be attached to an ear lobe containing three holes pierced therethrough. In this embodiment, the earring, shown generally as 56, contains bights 58 and 60 connected together by retaining portions 57, 59 and 61, respectively. The bights and retaining portions which are shaped in the form of succession squares.

Having so described the basic structure of the invention, it should be apparent that the earring may be adapted for use on an ear lobe with two or more holes pierced therethrough. Such number is limited only by the dimensions of the ear lobe. It should further be apparent that the bights of the earrings of the present invention may take the form of almost any geometric pattern. It therefore should be understood that other similar embodiments may be used or modifications and additions may be made to the described embodiments for performing the same functions of the present invention without deviating therefrom. Therefore, the present invention should not be limited to any single embodiment but rather construed in breadth and scope in accordance with the recitation of the appended claims.

I claim as my invention:

1. An ear ornament for attachment to an ear lobe through which a plurality of holes have been pierced, including:

a unitary rod member having a first bent portion, a second bent portion, and a central bent portion therebetween, said first and second bent portions being uniformly spaced apart by a distance selected to extend through at least two of said plurality of holes forming retaining members to retain the rod member on the ear lobe, and said central portion forming a bight.

2. The ear ornament of claim 1 wherein an ornamental member is attached to said bight.

3. The ear ornament of claim 1 wherein said bight forms a geometrical shape.

4. The ear ornament of claim 3 wherein said geometrical shape is a circle.

5. The ear ornament of claim 1 wherein said rod member further includes a plurality of bent portion and a central portion define a succession of convolutions which can be threaded through the plurality of holes pierced through the ear lobe.

6. The ear ornament of claim 5 wherein an ornamental member is attached to at least one of said bights.

7. The ear ornament of claim 5 wherein said bights form geometric shapes.

8. The ear ornament of claim 7 wherein said geometric shapes form a spiral convolution.

9. An ear ornament for attachment to an ear lobe through which a plurality of holes have been pierced, including:

a rod member having an alternating series of consecutively arranged bent retaining portions coupled with central portions therebetween, said bent retaining portions being being uniformly spaced from one another by a distance selected for extending through said plurality of holes, and said central portions forming brights.

10. The ear ornament of claim 9 wherein an ornamental member is attached to at least one of said bights.

11. The ear ornament of claim 9 wherein said bights form geometrical shapes.

12. The ear ornament of claim 11 wherein said geometric shapes form a spiral convolution.

* * * * *